US011690487B2

(12) United States Patent
Walker, Sr.

(10) Patent No.: US 11,690,487 B2
(45) Date of Patent: Jul. 4, 2023

(54) TOILET HANDLE COVER

(71) Applicant: Terrell M. Walker, Sr., Las Vegas, NV (US)

(72) Inventor: Terrell M. Walker, Sr., Las Vegas, NV (US)

(73) Assignee: Terrell M. Walker, Sr., Las Vegas, NV (US)

( * ) Notice: Subject to any disclaimer, the term of this patent is extended or adjusted under 35 U.S.C. 154(b) by 0 days.

(21) Appl. No.: 17/510,404

(22) Filed: Oct. 26, 2021

(65) Prior Publication Data

US 2023/0015744 A1 Jan. 19, 2023

Related U.S. Application Data

(60) Provisional application No. 63/259,445, filed on Jul. 19, 2021.

(51) Int. Cl.
*A47K 13/24* (2006.01)
*E03D 9/00* (2006.01)

(52) U.S. Cl.
CPC ..... *A47K 13/24* (2013.01); *E03D 9/007* (2013.01)

(58) Field of Classification Search
CPC ..... A47K 13/24
USPC ..... 4/222, 294
See application file for complete search history.

(56) References Cited

U.S. PATENT DOCUMENTS 2,611,136 A * 9/1952 Diamond ..... A47K 13/24 D23/311
2,652,875 A * 9/1953 Puste ..... E03D 1/01 150/154
2,963,710 A * 12/1960 Cecil ..... E03D 1/142 4/413
3,955,233 A * 5/1976 Nakamura ..... A45D 33/34 132/320
4,434,938 A * 3/1984 Rosenkrantz ..... E03D 9/007 239/289
4,512,046 A * 4/1985 Riggle ..... A47K 13/24 4/246.1
4,805,246 A * 2/1989 De Vargas ..... A47K 13/105 4/231
5,088,132 A * 2/1992 Walka ..... A47K 13/24 4/300.3
5,435,016 A * 7/1995 Smith ..... A47K 13/24 4/234
5,727,258 A * 3/1998 Derouin ..... A47K 13/105 4/246.1
5,810,525 A * 9/1998 Ector, Sr. ..... B25F 5/029 81/177.4

(Continued)

FOREIGN PATENT DOCUMENTS

CA 3054914 A1 * 3/2020 ..... A47K 13/005

*Primary Examiner* — Lori L Baker

(57) ABSTRACT

A toilet handle cover; the toilet handle cover includes an elongated cover featuring a plush material which is configured to conceal and contour a profile of a toilet handle. The elongated cover includes an opening having an elasticized hemline. The elasticized hemline extends along the opening and is configured to expand and secure the elongated cover to the toilet handle. The elongated cover further includes a textured interior lining for further securing the device to a toilet handle. The elongated cover is provided to reduce germ transfer and functionally enhance a bathroom environment.

19 Claims, 5 Drawing Sheets

(56) References Cited

U.S. PATENT DOCUMENTS

| | | | | |
|---|---|---|---|---|
| 5,870,015 | A * | 2/1999 | Hinkel | A47K 13/24 340/603 |
| 6,138,292 | A * | 10/2000 | O'Toole | A47K 13/24 4/405 |
| 6,499,155 | B1 * | 12/2002 | Barrios | E03D 5/02 4/249 |
| 6,594,831 | B1 * | 7/2003 | Pardo | E03C 1/308 4/300.3 |
| 6,634,032 | B1 * | 10/2003 | Janik | A47K 13/105 4/246.1 |
| 9,516,906 | B1 * | 12/2016 | Wiggins | B65D 85/18 |
| 9,579,002 | B2 * | 2/2017 | Smith | A47K 11/06 |
| 11,432,600 | B1 * | 9/2022 | Van Sant | A41D 13/087 |
| 2002/0152547 | A1 * | 10/2002 | Pardo | E03D 9/00 4/300.3 |
| 2006/0231120 | A1 * | 10/2006 | Knopow | B08B 1/00 15/210.1 |
| 2008/0052855 | A1 * | 3/2008 | Yang | A46B 15/0097 15/171 |
| 2009/0049590 | A1 * | 2/2009 | Foster | A47K 13/105 4/246.1 |
| 2011/0061274 | A1 * | 3/2011 | Pascarelli | G09F 1/08 40/538 |
| 2022/0168881 | A1 * | 6/2022 | Kessler | B25G 1/102 |

* cited by examiner

TOILET HANDLE COVER

CROSS-REFERENCE TO RELATED APPLICATION(S)

The present application is related to and claims priority to U.S. Provisional Patent Application No. 63/259,445 filed Jul. 19, 2021, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of bathroom accessories of existing art and more specifically relates to sanitary bathroom accessories.

RELATED ART

It is the normal practice to depress toilet flushing handles by grasping the handle with the fingers and grabbing tightly to complete a depressing procedure. In the practice of this procedure, contamination from the surface of the handle can readily transfer to the skin of the user, which is an unsanitary and nonhygienic event. Toilet levers in American households carry an average of 83 bacterial microorganisms. Not just ordinary germs and bacteria, either, but pathogens known to cause serious and even fatal diseases, like *E. Coli*, Staph, and even COVID-19. Those smooth and solid surfaces of the levers don't just comfortably host them; they actually give them a place to reproduce. A suitable solution is desired.

U.S. Pat. No. 6,138,292 to Sean M. O'Toole relates to a cover for a toilet handle. The described cover for a toilet handle includes a novelty cover used for commercial advertising, for the flush handle of commercially made toilets and urinals. One is a container, where printed matter which illustrates a particular advertisement is inserted between two tubes that make up a unitary piece. A second is a molded replica of a novelty piece or the actual product being advertised. Each embodiment is attached in the same manner by a Nylon, plastic, or rubber sleeve that slides onto the metal flush handle of a toilet and tightly fit onto the smallest diameter of the toilet flush handle by at least two Allen screws.

SUMMARY OF THE INVENTION

In view of the foregoing disadvantages inherent in the known sanitary bathroom accessory art, the present disclosure provides a novel toilet handle cover. The general purpose of the present disclosure, which will be described subsequently in greater detail, is to provide a toilet handle cover for substantially encapsulating toilet tank levers to help reduce germ transfer and enhance safety from germs in a bathroom environment.

A toilet handle cover is disclosed herein. The toilet handle cover includes an elongated cover preferably comprising a plush material which is configured to conceal and contour a profile/body of a toilet handle. The elongated cover includes an opening having an elasticized hemline. The elasticized hemline extends along the opening and is configured to expand and secure the elongated cover to the toilet handle. The elongated cover further includes a textured interior lining. The elongated cover is configured to reduce germ transfer and functionally enhance a bathroom environment.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a toilet handle cover, constructed and operative according to the teachings of the present disclosure.

The various embodiments of the present invention will hereinafter be described in conjunction with the appended drawings, wherein like designations denote like elements.

DETAILED DESCRIPTION

Figure 1:
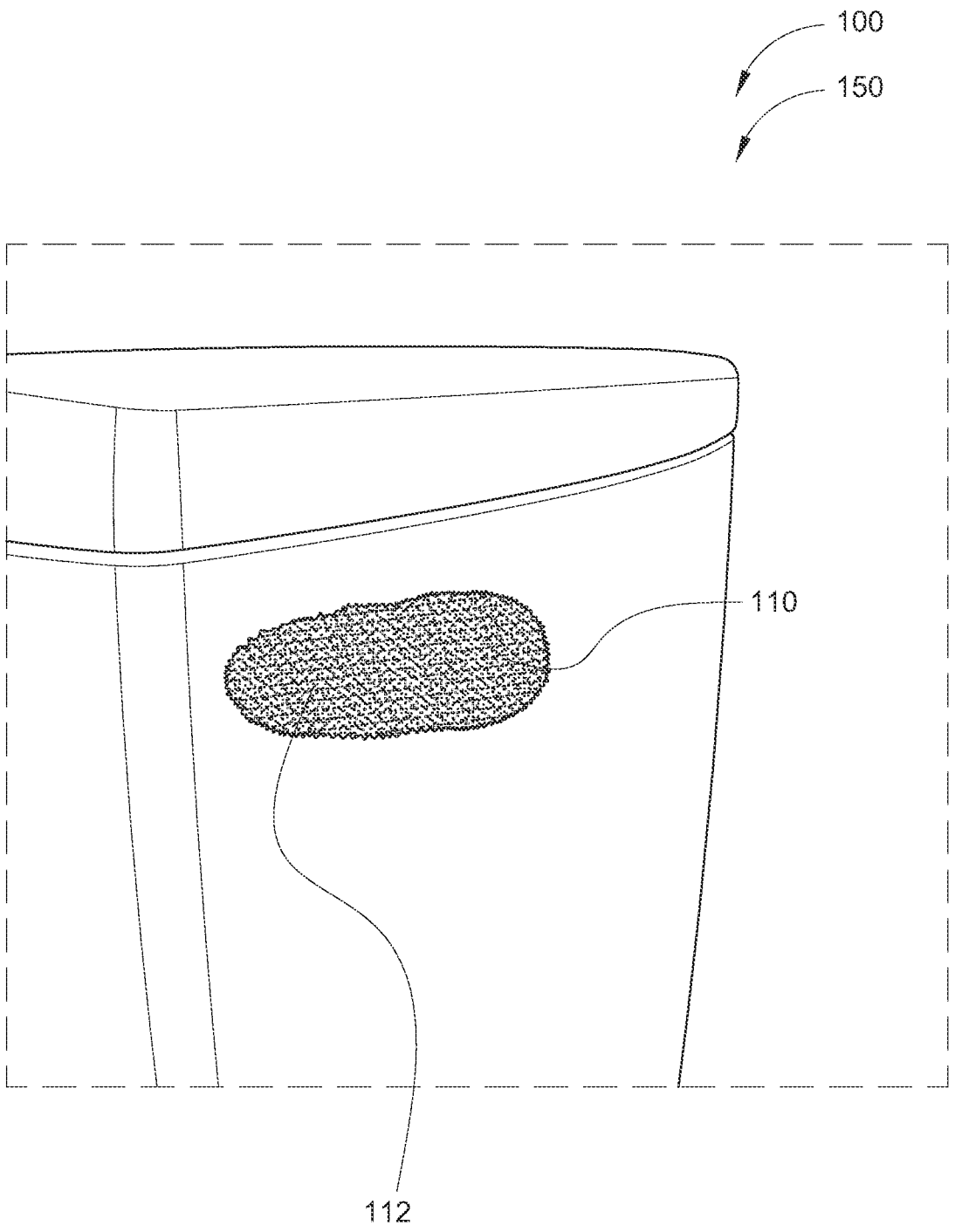
FIG. 1 is a perspective view of the toilet handle cover during an 'in-use' condition, according to an embodiment of the disclosure.

As discussed above, embodiments of the present disclosure relate to a sanitary bathroom accessory and more particularly to a toilet handle cover as used to improve the cleanliness of bathrooms.

Generally, the toilet handle cover includes a protective toilet handle cover provided to help reduce germ transfer and enhance a bathroom environment. The cover is shaped to contour a profile of the body of the toilet handle and completely encase the toilet handle to provide a functional and decorative cover. The toilet handle cover prevents collection and transmission of germs, bacteria, viruses and waste product; hereinafter referred to as pathogens. Additionally, the toilet handle cover protects its hosting toilet handle from common damages in appearance and to structure. The cover may feature an elasticized hem to further secure the device to the toilet handle and maintain its placement thereon. The toilet handle cover further includes a rubberized, textured lining upon its interior surface to further secure the cover upon a toilet handle. The device may be modified for application upon other levers, handles, and similar items, such as but not limited to door handles, appliance handles, and stove knobs.

The invention may be infused with a germ-killing substance that is activated when touched by a user. Such substances may include but are not limited to ethyl alcohol, isopropyl alcohol, and/or hydrogen peroxide in various concentrations. Other substances may be included such as glycerol and glycerin to prevent/slow evaporation of the germ-killing substance. Additionally, the cover may feature a scented (improved scent) substance that may be released when touched by the user. The scents may be oil, alcohol or water based, and they may include glycerol and/or glycerin to prevent/slow evaporation of the scent.

In a preferred embodiment, the toilet handle cover is made of woven polypropylene material with a plush surface plane, and in a semi-cylindrical shape with one open plane. An elasticized hemline extends from the opposite and proximal end of the device. The interior plane of the device is lined with a textured anti-slip material, made of a synthetic thermoplastic elastomer.

The toilet handle cover can be produced in colors and/or patterns that match, correspond, and/or complement those in bathroom mats, lid covers, and seat covers, furthering its provision of decorative enhancement. The toilet handle cover may be made in specific sizes, shapes, and designs intended for corresponding application upon specific models of toilet handles, and/or may be made in a single generalized size, shape and design for universal application upon many different toilet tank levers. The toilet handle cover can be made of various applicable materials, such as but not limited to polypropylene, cotton, polyester, nylon, chenille and any combination of these and other materials. The interior lining of the toilet handle cover can be made of various applicable materials, such as but not limited to various thermoplastic elastomers and silicone. The toilet handle cover can also be made without any interior lining. The toilet handle cover may or may not include an elasticized hem. In versions without an elasticized hem, the toilet handle cover may or may not include other devices, such as but not limited to a button, snap, or drawstring, for its securement upon a hosting toilet handle. It can be made in variations that include an antimicrobial agent in its material. The toilet handle cover can be provided in variations that include a scenting material, and in the variations, various scents may be used.

A method of use may be as follows: A user may simply apply (place) the toilet handle cover upon a toilet handle. With this application, the toilet handle cover immediately enhances the appearance of the hosting bathroom. Additionally, this application effectively prevents any pathogens from making direct contact with the smooth planar surface of the lever. By blocking such contact, the toilet handle cover prevents any pathogen reproduction that would ordinarily occur quite easily upon the lever, if it had remained exposed. This restricts pathogen contact to the textured exterior surface of the toilet handle cover, upon which most pathogens and germs cannot reproduce. The user may then relieve any concerns of applying pathogens to and/or acquiring pathogens from the toilet handle. Whenever desired, the toilet handle cover can be easily removed from its hosting toilet handle for washing.

Referring now more specifically to the drawings by numerals of reference, there is shown in FIGS. 1-5, various views of a toilet handle cover 100.

FIG. 1 shows a toilet handle cover 100 during an 'in-use' condition 150, according to an embodiment of the present disclosure. Here, the toilet handle cover 100 may be beneficial for use by a user to improve cleanliness of a bathroom by reducing germ transfer. As illustrated, the toilet handle cover 100 may include an elongated cover 110 comprising a plush material 112 which is configured to conceal and contour a profile of a toilet handle. The elongated cover 110 includes an opening 118 in certain embodiments having an elasticized hemline 130. The elasticized hemline 130 extends along the opening 118 and is configured to expand and secure the elongated cover 110 to the toilet handle 10. The elongated cover 110 further includes a textured interior lining 140. The elongated cover 110 is configured to reduce germ transfer and functionally enhance a bathroom environment.

Figure 2:
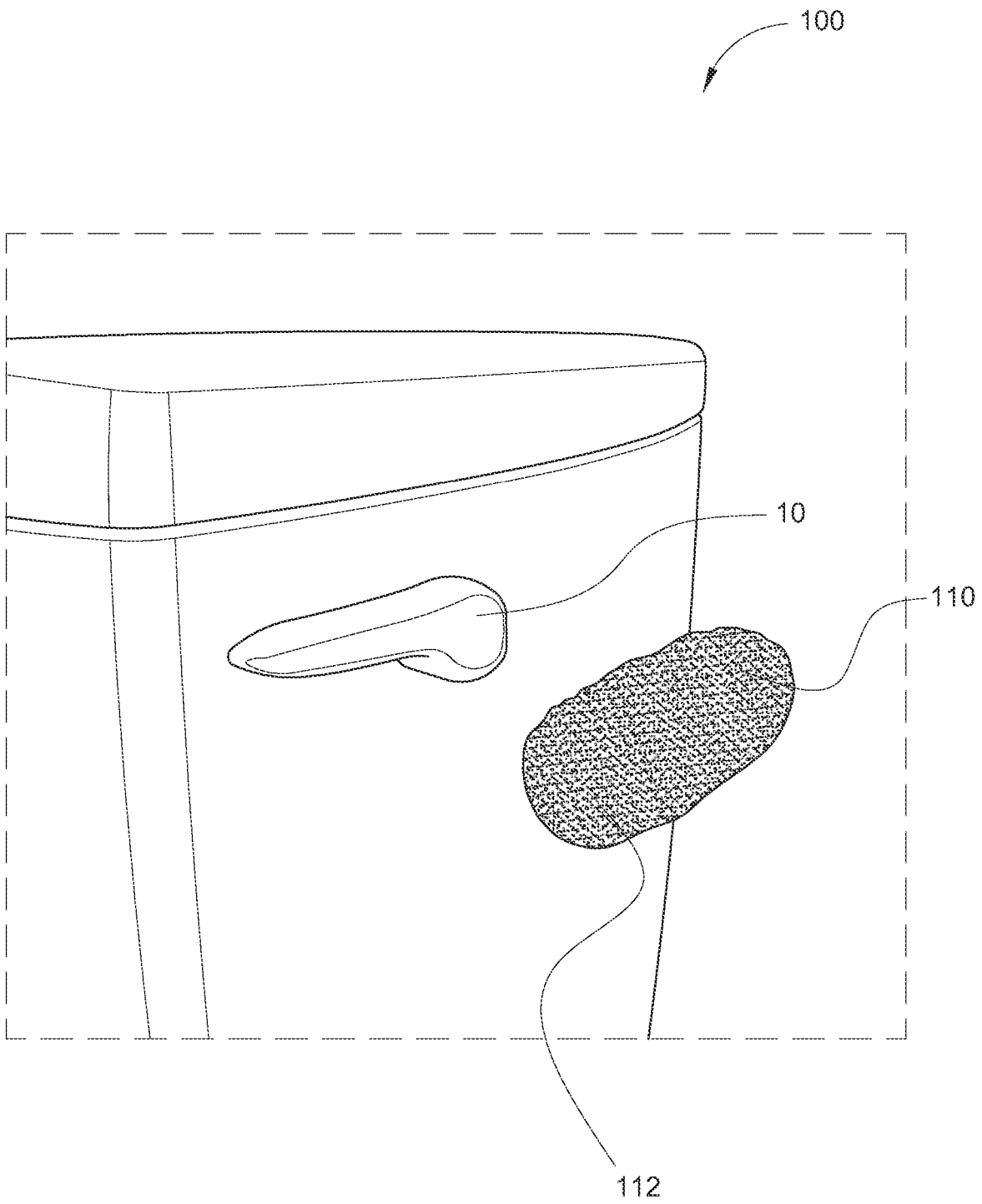
FIG. 2 is a perspective view of the toilet handle cover of FIG. 1 during a 'ready-for-use' condition, according to an embodiment of the present disclosure.

FIG. 2 shows the toilet handle cover 100 of FIG. 1, according to an embodiment of the present disclosure. As above, the toilet handle cover 100 may include the elongated cover 110 comprising a plush material 112 and having the opening 118 featuring the elasticized hemline 130 and the textured interior lining 140. The plush material 112 of the elongated cover 110 may include polypropylene, cotton, polyester, nylon, chenille, and the like. In a preferred embodiment, the elongated cover 110 is washable and reusable.

The toilet handle cover 100 may also be provided in disposable variations intended for single use, such as for individual use in public restrooms. In such variations, the toilet handle cover 100 can be made of various materials, such as paper, and may or may not be coated on its exterior surface with various protective films, such as but not limited polyvinyl acetate (PVA). Such variations may be packaged for individual consumer purchase and use and/or in bulk-unit packages for display and access in public restrooms. The elongated cover 110 is sized and configured to cover a substantial portion of the toilet handle 10. The toilet handle cover 100 effectively prevents pathogens from direct contact with toilet tank levers and prevents the pathogens from further developing and reproducing upon such surface.

Figure 3:
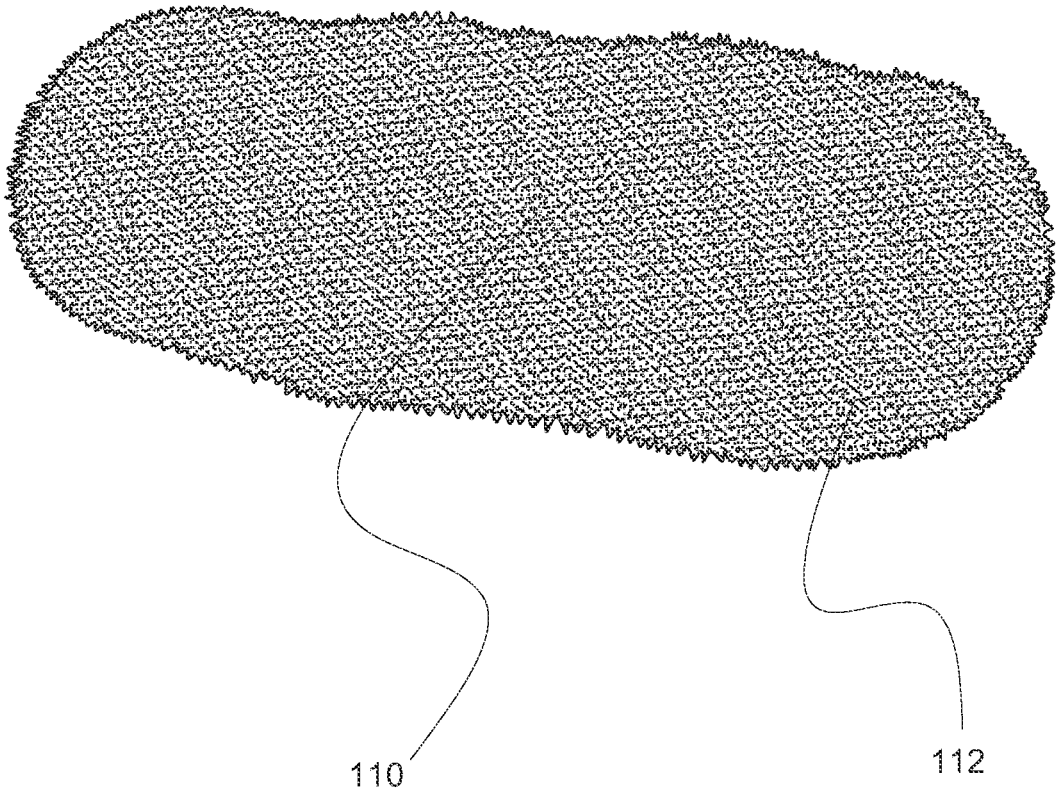
FIG. 3 is a front view of the toilet handle cover of FIG. 1, according to an embodiment of the present disclosure.

FIG. 3 is a front view of the toilet handle cover 100 of FIG. 1, according to an embodiment of the present disclosure. As shown, the elongated cover 110 comprises a semi-cylindrical shape. In certain embodiments, the elongated cover 110 may include (functional and non-functional) indicia. The toilet handle cover 100 protects the toilet handle 10 it covers and prevents damages to the toilet handle 10. The toilet handle cover 100 eliminates its hosting tank lever from exposure to high humidity and moisture, along with other elements commonly found in bathrooms. By preventing contact with moisture, the toilet handle cover 100 prevents metal toilet tank levers from accumulating rust due to oxidation in bathroom environments.

Figure 4:
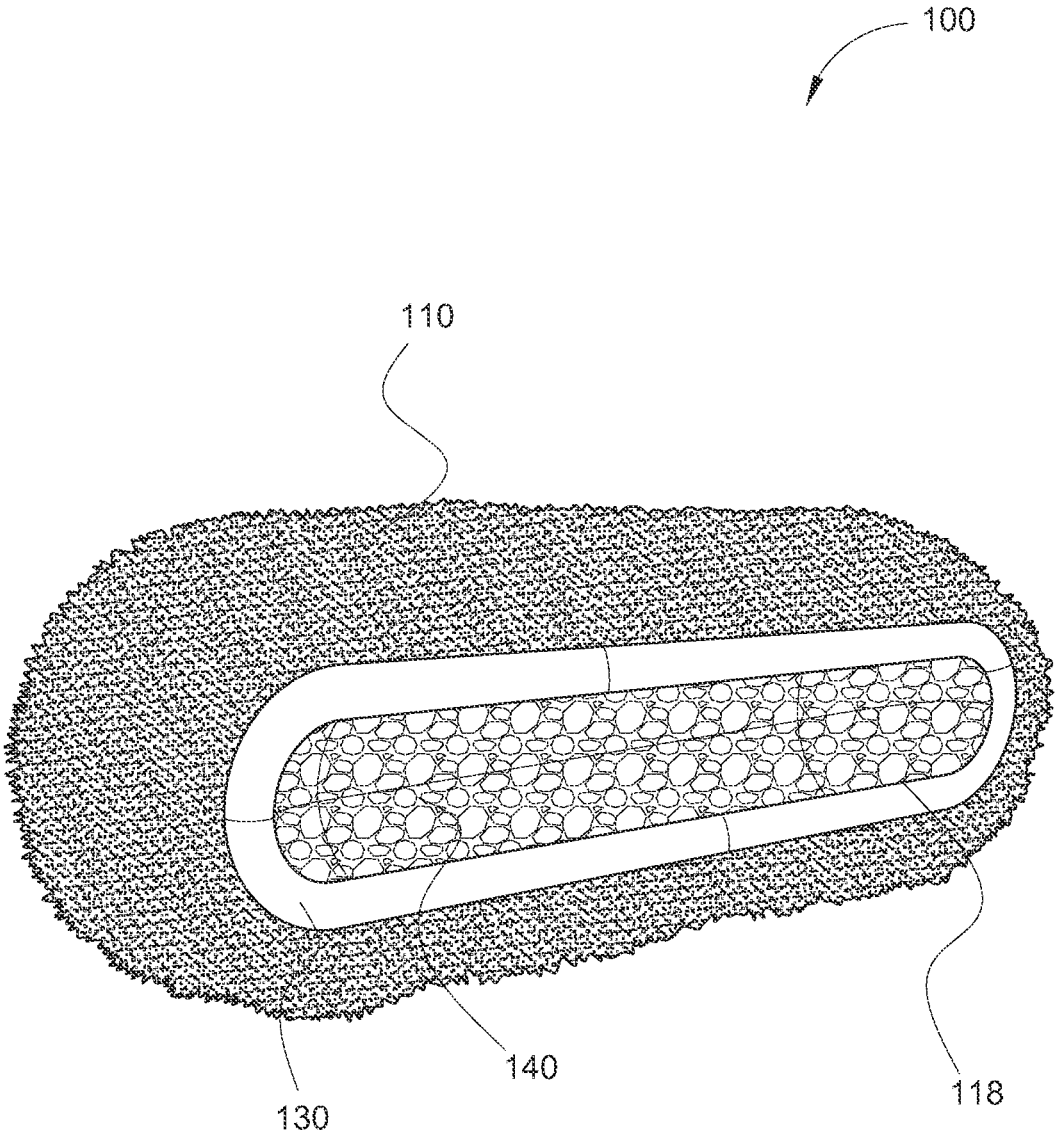
FIG. 4 is a rear perspective view of the toilet handle cover of FIG. 1, according to an embodiment of the present disclosure.

FIG. 4 is a rear perspective view of the toilet handle cover 100 of FIG. 1, according to an embodiment of the present disclosure. As further shown in FIG. 4, the elongated cover 110 has the opening 118 comprising the elasticized hemline 130 extending along the opening 118 and the textured interior lining 140. The textured interior lining 140 may include a synthetic thermoplastic elastomer. In alternative embodiments, the elongated cover 110 does not include the textured interior lining 140. In certain embodiments, the elasticized hemline 130 may be replaced by a fastener such as a clip, buttons, clasps, and other suitable fastening means for securing the elongated cover 110 on a toilet handle 10. The toilet handle cover 100 prevents collection and transmission of various pathogens that are commonly hosted upon toilet handles 10, due to their common presence in bathroom environments.

Figure 5:
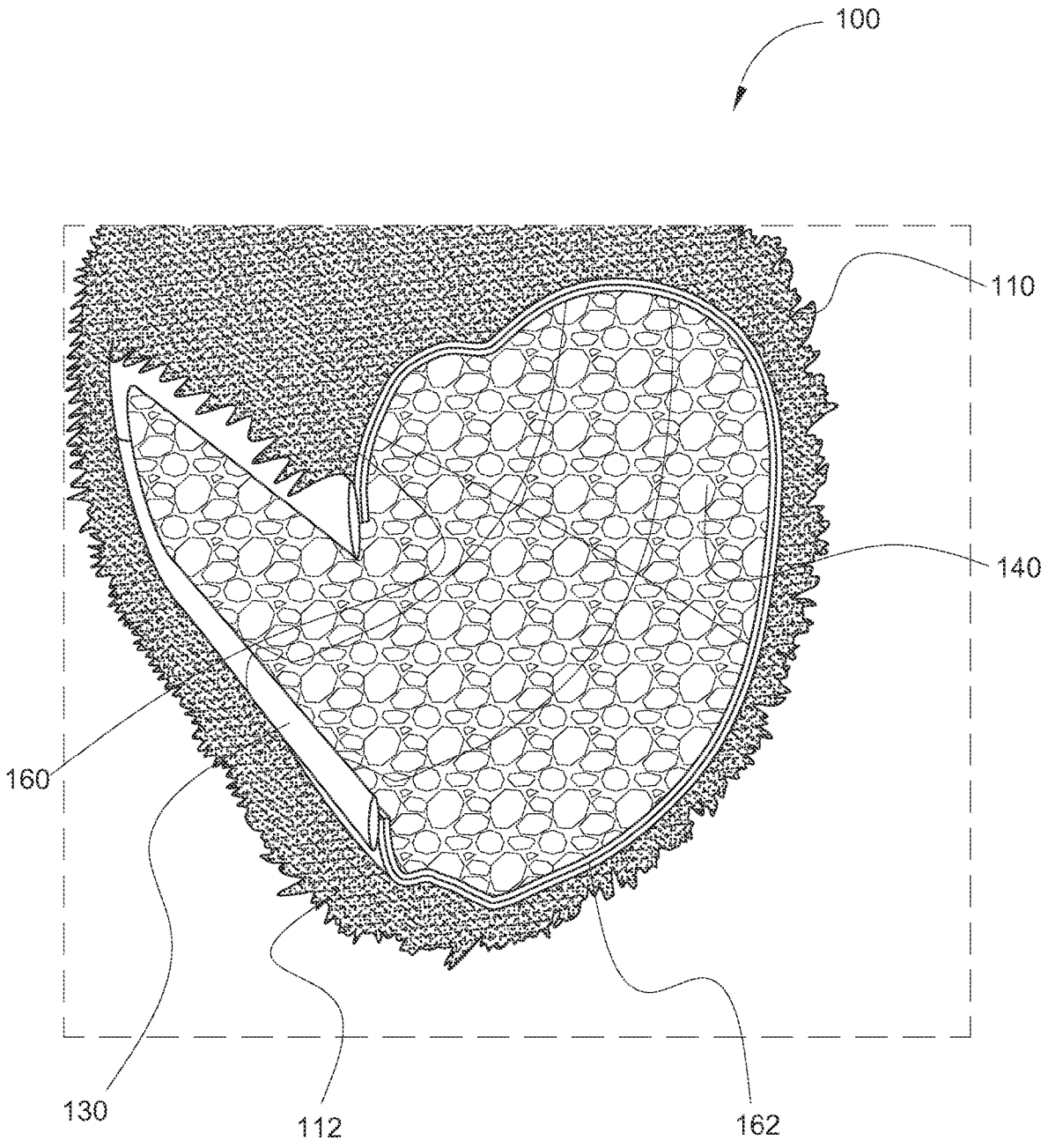
FIG. 5 is a cutaway view of the toilet handle cover of FIG. 1, according to an embodiment of the present disclosure.

FIG. 5 is a cutaway view of the toilet handle cover 100 of FIG. 1, according to an embodiment of the present disclosure. The elongated cover 110 further comprises at least one layer 160 impregnated with at least one substance 162 including a germ-killing substance and a scented substance. The germ-killing substance may include ethyl alcohol, isopropyl alcohol, hydrogen peroxide, or other germ-killing substances for reduce germ transfer and buildup. The germ-killing substance is activated when touched by a user and the scented substance may be released when touched by the user. The scented substance may include a variety of scents and scented substances including but not limited to oil, alcohol and water based scent-enhancing substances. The at least one substance 162 may further include an evaporation prevention substance such as glycerol and/or glycerin to prevent evaporation of the scented substance and the germ-killing substance.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A toilet handle cover, the toilet handle cover comprising:

an elongated cover comprising a plush material which is configured to conceal and contour a profile of a toilet handle, said elongated cover includes, an opening having, an elasticized hemline extending along said opening and is configured to expand and secure said elongated cover to said toilet handle, and a textured interior lining, at least one substance includes an evaporation prevention substance to prevent evaporation of a scented substance and said germ-killing substance, and wherein said elongated cover is configured to reduce germ transfer and functionally enhance a bathroom environment.

2. The toilet handle cover of claim 1, wherein said elongated cover further comprises at least one layer impregnated with at least one substance.

3. The toilet handle cover of claim 2, wherein said at least one substance comprises a germ-killing substance.

4. The toilet handle cover of claim 3, wherein said germ-killing substance is selected from the group consisting of ethyl alcohol, isopropyl alcohol, and hydrogen peroxide.

5. The toilet handle cover of claim 4, wherein said germ-killing substance is activated when touched by a user.

6. The toilet handle cover of claim 5, wherein said at least one substance further comprises a scented substance.

7. The toilet handle cover of claim 6, wherein said scented substance is released when touched by said user.

8. The toilet handle cover of claim 7, wherein said scented substance is selected from the group consisting of oil, alcohol and water based scent-enhancing substances.

9. The toilet handle cover of claim 8, wherein said evaporation prevention substance is selected from a group including glycerol and glycerin.

10. The toilet handle cover of claim 1, wherein said plush material of said elongated cover is selected from the group consisting of polypropylene, cotton, polyester, nylon, and chenille.

11. The toilet handle cover of claim 1, wherein said textured interior lining comprises a synthetic thermoplastic elastomer.

12. The toilet handle cover of claim 1, wherein said elongated cover does not include said textured interior lining.

13. The toilet handle cover of claim 1, wherein said opening of said elongated cover comprises a fastener.

14. The toilet handle cover of claim 1, wherein said elongated cover comprises a semi-cylindrical shape.

15. The toilet handle cover of claim 1, wherein said elongated cover is sized and configured to cover a substantial portion of said toilet handle.

16. The toilet handle cover of claim 1, wherein said elongated cover is washable and reusable.

17. The toilet handle cover of claim 1, wherein said elongated cover is disposable.

18. The toilet handle cover of claim 1, wherein said elongated cover includes indicia.

19. A toilet handle cover, said toilet handle cover comprising:

an elongated cover comprising a plush material which is configured to conceal and contour a profile of a toilet handle, said elongated cover includes, an opening having, an elasticized hemline extending along said opening and is configured to expand and secure said elongated cover to said toilet handle, and a textured interior lining, and wherein said elongated cover is configured to reduce germ transfer and functionally enhance a bathroom environment;

wherein said elongated cover further comprises at least one layer impregnated with at least one substance;

wherein said at least one substance comprises a germ-killing substance;

wherein said germ-killing substance is selected from the group consisting of ethyl alcohol, isopropyl alcohol, and hydrogen peroxide;

wherein said germ-killing substance is activated when touched by a user;

wherein said at least one substance further comprises a scented substance;

wherein said scented substance is released when touched by said user;

wherein said scented substance is selected from the group consisting of oil, alcohol and water based scent-enhancing substances;

wherein said at least one substance further includes an evaporation prevention substance to prevent evaporation of said scented substance and said germ-killing substance;

wherein said evaporation prevention substance is selected from a group including glycerol and glycerin;

wherein said plush material of said elongated cover is selected from the group consisting of polypropylene, cotton, polyester, nylon, and chenille;

wherein said textured interior lining comprises a synthetic thermoplastic elastomer;

wherein said elongated cover comprises a semi-cylindrical shape;

wherein said elongated cover is sized and configured to cover a substantial portion of said toilet handle; and wherein said elongated cover is washable and reusable.

* * * * *